United States Patent [19]

Brinkley

[11] 4,054,699

[45] Oct. 18, 1977

[54] CHIP TILE PATTERN AND FLOOR CONTAINING SAME

[76] Inventor: Jerry A. Brinkley, 1416 First Ave., Winchester, Tenn. 37398

[21] Appl. No.: 717,619

[22] Filed: Aug. 25, 1976

[51] Int. Cl.[2] ..... E04C 1/24

[52] U.S. Cl. ..... 428/48; 156/71; 156/285; 428/204; 428/49; 428/46

[58] Field of Search ..... 428/40, 41, 48, 47, 428/49, 202, 203, 206, 240, 246, 323; 156/62.2, 63, 71, 285

[56] References Cited

U.S. PATENT DOCUMENTS

| | | | |
|---|---|---|---|
| 2,585,115 | 2/1952 | Greenlee | 260/32.8 N |
| 2,602,785 | 7/1952 | Wiles et al. | 260/2 N |
| 3,056,224 | 10/1962 | Almy et al. | 428/48 X |
| 3,135,647 | 6/1964 | Wheeley | 156/247 X |
| 3,401,069 | 9/1968 | Lorentzen | 428/315 X |
| 3,461,016 | 8/1969 | Irving, Jr. et al. | 156/62.2 X |
| 3,560,315 | 2/1971 | Evans et al. | 156/71 X |
| 3,562,076 | 2/1971 | Lea | 428/331 X |
| 3,682,741 | 8/1972 | Elliott et al. | 156/63 X |
| 3,690,914 | 9/1972 | Andreski | 427/203 |

*Primary Examiner*—George F. Lesmes
*Assistant Examiner*—Henry F. Epstein
*Attorney, Agent, or Firm*—Abe Hatcher

[57] ABSTRACT

A seamless pattern tile made by bonding a paper, plastic or like pattern, preferably with chips sprinkled thereon in an adhering manner, to a floor or like substrate, which may be of a contrasting color.

4 Claims, 4 Drawing Figures

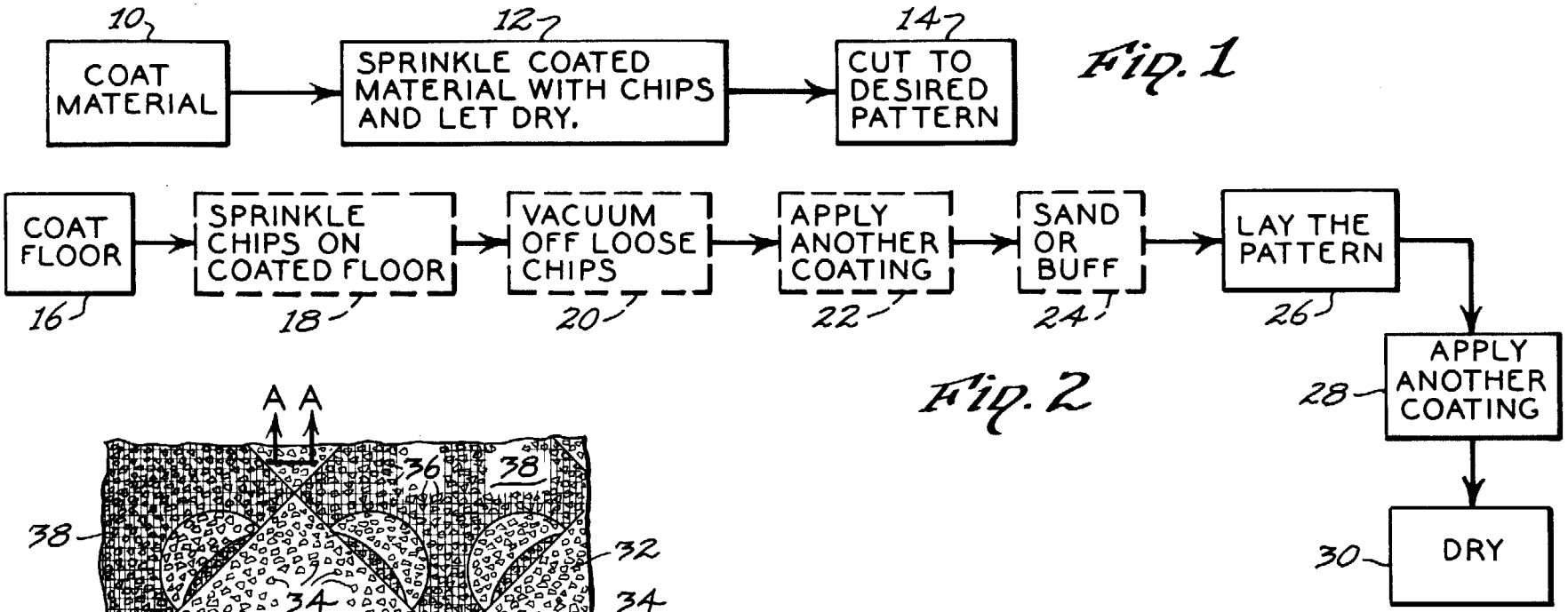
Fig. 1
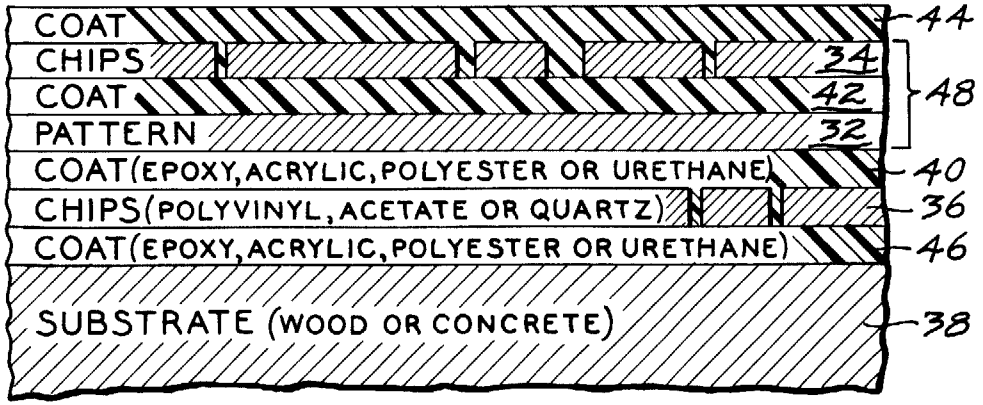
Fig. 2
Fig. 4
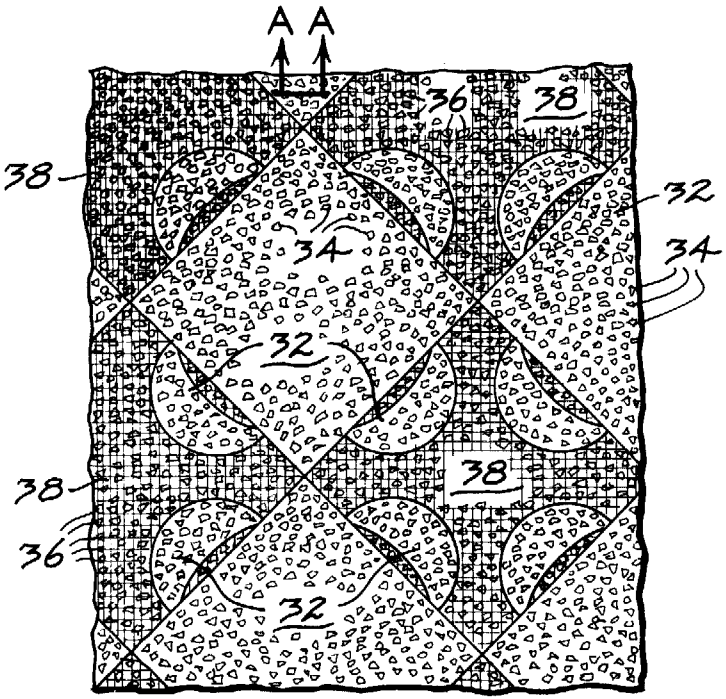
Fig. 3

CHIP TILE PATTERN AND FLOOR CONTAINING SAME

BACKGROUND OF THE INVENTION

1. Field of the Invention

This invention relates to patterns or designs for seamless floors. More particularly, it relates to a seamless floor covering made by laying an adhering paper, plastic or like pattern on a coated floor, wall or like substrate.

2. Description of the Prior Art

Heretofore the only way to create a seamless floor tile pattern has been to place on the desired surface a cut grid, apply a coating, and then remove the grid.

SUMMARY OF THE INVENTION

After extended investigation, I have found a way to apply a pattern to a floor or like substrate without such a cumbersome and time-consuming operation. What I do is to apply to the substrate an epoxy, urethane, acrylic, polyester, or like resin base coat and then lay down a design or pattern of sheet material in a manner such that it adheres to the substrate, either by means of a conventional adhesive, for example, plastic or paste, or, when applied while the substrate is still wet, by means of the base coat. One or more further resin coats may also be applied.

The substrate to which the various coats and pattern are applied according to my invention may be cement (concrete), wood, brick, asphalt, metal, plastic or the like.

Any conventional epoxy resin may be used for the coats according to my invention. For example, it may be one made by reacting a mole of a polyhydric phenol with one to two or more moles of a polyfunctional halohydrin in the presence of an amount of an alkaline material at least sufficient, and usually up to 30% in excess, to combine with or neutralize the product or products liberated from the halohydrin. U.S. Pat. Nos. 2,585,115 and 2,602,785 describe certain suitable epoxy resins. A representative epoxy resin is produced by the reaction of 2,2-bis (4-hydroxyphenyl) propane, commonly known as bisphenol, with epichlorhydrin in the presence of an alkali such as caustic soda. Commonly known epoxies include ERL, Epi-Roz, Hysol, Epon, Araldite and Bakelite. For example, the epoxy resin may be made up of Araldite 508 (17.25%), a blend of a polyglycol epoxy resin with the condensation product of a bisphenol alphaepichlorhydrin epoxy resin and 31.89% Araldine 6004, a reaction product of epichlorhydrin and 2,2-bis (4-hydroxyphenyl) propane, 5700 centipoises, and the balance flow control agent, silicone reacted with a tallate, viscosity control agent, filler, pigment, water and curing agent.

The urethane used in coating according to the invention may be a urethane lacquer composed of a urethane solid which is in a xylene solution, for example, a solution containing a 42% solid urethane held in solution by the xylene. It may also be a two-component polyurethane elastomer made up of a high molecular weight polyhydric alcohol (for example, 100 parts by weight) and an isocyanate prepolymer, for example, 20½ parts by weight of the reaction product of a high molecular weight polyester alkyd having terminal hydroxy groups that have been reacted with an organic isocyanate. The two components may be sprayed through a spray gun in which a suitable peroxide catalyst may be used.

The acrylic resin used in pattern coating according to the invention may be, for example, an ethyl or methylmethacrylate polymer. Acrylic resins useful in producing the pattern tile of the invention include polymers of acrylic acid and related acrylic compounds. They are sometimes referred to as polyacrylates and are often prepared by polymerization of acrylic esters, being represented by methyl and ethyl acrylate polymers. Another name for acrylics is acryloid plastics. Alpha-substituted derivatives of acrylic esters also polymerize readily. Methyl methacrylate polymer is available under the trade names Plexiglas, Lucite and Crystallite, for example.

A polyester such as useful in coating in my invention may be, for example, derived from (1) a base resin component of at least 40% by weight of an alkyd derived from a diol such as ethylene or propylene glycol and isophthalic acid and up to 60% by weight of an alkyd resin derived from a diol and orthophthalic acid, (2) 25% to 35% by weight, based on the weight of the base resin component of maleic anhydride, and (3) a terminally ethylenically-unsaturated monomer, preferably stryene or methyl methacrylate, in an amount equivalent to 25% to 35% by weight, based on the weight of the resin component.

The sheet material which I lay down in seamless pattern form has a thickness of 1/32 to ¼ inch, preferably 1/16 to ⅛ inch, and has a weight of about 1–8 pounds per 100 square feet and is preferably made of paper, although it may also be of a plastic, fabric or similar substance, provided it is flexible and capable of being cut and laid in any desired shape and will adhere to a floor, wall or like substrate, either coated or uncoated. Examples of paper which may be used include Kraft paper, asphalt paper, felt paper and the like. Another example of suitable paper is Ludlow Drystick gummed on the back such as distributed by Southern Paper Company.

I prefer that my design or pattern be chipped, that is, sprinkled with chips or chip aggregate randomly scattered thereon, and that it be of a different color or shade from the rest of the floor, which may also have chips applied thereto by sprinkling on the base coating while still wet. Loose chips, in either instance, may be vacuumed off evenly after the resin coat to which they adhere dries or cures. The chips or chip aggregate employed in the present invention may have any desired particle configuration and size, usually ranging, for example, from 1/16 to 1 inch in diameter, and preferably being of irregular shape. The chips or chip aggregate may be used in any desired proportion in the resin, for example, from about 0.2 to 10 parts of the resin.

I prefer to sprinkle chips over the entire floor surface while wet after applying the base coat, which may be pigmented, and then letting it dry before vacuuming off any loose chips.

Pigments or fillers which may be embedded in the epoxy, acrylic, urethane, polyester or like resins useful as coating material in my invention include sand, marble dust, silica, barytes, mica, silicates, calcium sulfate, alumina, corundum diatomaceous earth, burnt clays, ground slag, and the like.

As chips or chip aggregate I prefer to use quartz various plastics such as polyvinyl acetate and phenolic resin, aggregate chip, and walnut shell chip.

For chips I have used polyvinyl acetate manufactured by Jerico Industries. I have also had good success with aggregate as manufactured by the 3M Company under the name of Color-quartz Grade 28 ASTM-D451, 95% passes through 20 mesh Tyler screen (No. 20 US Std), 95% retained on 65 mesh Tyler screen (No. 70 US Std).

After vacuuming off any loose chips, I prefer to apply a second coat of epoxy, urethane, acrylic, polyester, or like resin, preferably clear, let it dry, and next sand or buff the whole surface, for example, with a 00 grit, preferably before putting on another coat of resin. According to the invention the coats may be applied by brushing, spraying, trowelling or other conventional technique.

Following the sanding or buffing, I lay down the design or pattern which, according to one embodiment of my invention, is preferably coated beforehand with an epoxy, urethane, acrylic, polyester or like resin such as described hereinabove, sprinkled with chips, dried and then cut, preferably die-cut, into the desired design or pattern, for example, as shown in FIG. 1 of the drawing, which will be described hereinafter, prior to laying down. The sheet material used for the pattern or design preferably has a pull-off type, self-adhesive, peelable paper on the side to be adhered to the coated substrate. Alternatively, it may simply have a conventional adhesive applied to the backside for adhering it to the coated and dried substrate, or be pressed directly onto the resin-coated substrate while wet so that it adheres thereto upon drying or curing.

After inserting the sheets of pattern or design, preferably starting from the center and working outward, using individual sections or pieces, ordinarily substantially identical in shape, I prefer to use a roller to roll on another similar coat of epoxy, urethane, acrylic, polyester or similar resin, preferably clear. This causes my pattern or design to be sandwiched between a bottom and top layer of the resin so that it is embedded to form a part of the floor or like surface. I then let the pattern tile surface dry, sand it lightly again, and put on as many additional coats of epoxy, urethane, acrylic, polyester or like resin as desired, without any further sanding being required.

DESCRIPTION OF THE DRAWING AND PREFERRED EMBODIMENT

For a better understanding of my invention and an illustration of a preferred embodiment, reference will now be made to the drawing, in which:

FIG. 1 is a schematic flow sheet depicting how the sheet material used in making my pattern tile is manufactured according to the invention.

FIG. 2 is a schematic representation in flow sheet form illustrating how to produce the pattern tile product of the invention.

FIG. 3 is a top view of a substrate which has seamless pattern tile laid thereon according to the invention.

FIG. 4 is a cross-section showing the respective layers of a pattern tile product of the invention as shown from above in FIG. 3.

In FIG. 1 sheet material, preferably containing an adhesive backing having a thin paper thereon adapted to be pulled therefrom to leave the adhesive ready to stick it to a coated floor or like substrate, is coated with epoxy, urethane, acrylic, polyester or like resin at 10, sprinkled with chips at 12 and cut, preferably by die cutting, into a pattern at 14.

Referring now to FIG. 2, a floor or similar substrate, such as a wood or concrete surface, is coated, with epoxy, urethane, acrylic, polyester or like resin at 22 and sanding or buffing at 24 after drying. A pattern such as that produced at 14 of FIG. 1 is then laid on the chipped and coated floor at 26 prior to coating it again at 28 and then drying.

FIGS. 3 and 4 show, respectively, a top view and a cross section of a substrate 38 containing, in respective order, a first plastic coat 46, chips 36 adhering to the plastic coat 46, a second plastic coat 40, a chipped paper pattern 48 made up of respective layers, from bottom to top, of sheet material 32, a resin or plastic coat 42 and chips 34 (prepared in advance as shown in FIG. 1 and laid or put down as a single chipped pattern layer 48), and a top plastic coat 44. Additional coats of epoxy, acrylic, urethane, polyester or like resin may be added on top of layer 44, if desired.

While the invention has been described in terms of preferred embodiments, the claims appended hereto are intended to encompass all embodiments which fall within the spirit of the invention.

Having thus described my invention and certain preferred embodiments thereof, I claim:

1. A method of preparing a tile pattern surface which comprises applying resin selected from the group consisting of epoxy, urethane, acrylic and polyester to a concrete, wood or Masonite surface, sprinkling polyvinyl acetate or quartz chips over the coated surface, drying the surface, vacuuming off loose chips from said surface, topping the coated, chipped surface with said resin, sanding or buffing the resulting coated, chipped and topped surface, tiling by adhering to said coated, chipped and topped surface a plurality of resin coated and chipped sheets of material each of a particular design so as to form a pattern, applying another coat of said resin and drying it, thereby sandwiching the pattern between two layers of said resin, to embed it as a part of a pattern tile surface, drying the surface, sanding said surface again and then applying and drying at least one other coat of said resin without further sanding.

2. The product formed by the method of claim 1.

3. A method of preparing a tile pattern surface which comprises applying resin selected from the group consisting of epoxy, urethane, acrylic and polyester to a concrete, wood or Masonite surface, sprinkling polyvinyl acetate or quartz chips over the coated surface, drying the surface, topping the coated, chipped surface with resin, tiling by adhering to said coated, chipped and topped surface a plurality of resin coated and chipped sheets of material each of a particular design so as to form a pattern, applying another coat of said resin and drying it, thereby sandwiching the pattern between two layers of said resin, to embed it as a part of a pattern tile surface.

4. The product formed by the method of claim 3.

* * * * *